US011164504B2

(12) United States Patent
Okamoto

(10) Patent No.: US 11,164,504 B2
(45) Date of Patent: Nov. 2, 2021

(54) DISPLAY DEVICE, CONTROL DEVICE, AND METHOD FOR CONTROLLING DISPLAY DEVICE

(71) Applicant: SHARP KABUSHIKI KAISHA, Sakai (JP)

(72) Inventor: Takuya Okamoto, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/807,978

(22) Filed: Mar. 3, 2020

(65) Prior Publication Data

US 2020/0286419 A1 Sep. 10, 2020

(30) Foreign Application Priority Data

Mar. 8, 2019 (JP) ..... JP2019-043090

(51) Int. Cl.

| | |
|---|---|
| ***G09G 3/3208*** | (2016.01) |
| ***G09G 3/3233*** | (2016.01) |
| ***G09G 3/20*** | (2006.01) |
| *G09G 3/00* | (2006.01) |

(52) U.S. Cl.

CPC ..... *G09G 3/2007* (2013.01); *G09G 3/3208* (2013.01); *G09G 3/3233* (2013.01); *G09G 3/00* (2013.01); *G09G 2320/029* (2013.01); *G09G 2320/0276* (2013.01); *G09G 2320/043* (2013.01)

(58) Field of Classification Search

CPC .... G09G 3/006; G09G 3/2007; G09G 3/3208; G09G 3/3233; G09G 2300/0819; G09G 2300/0861; G09G 2320/0276; G09G 2320/029; G09G 2320/0295; G09G 2320/045; G09G 2340/00; G09G 2340/16

See application file for complete search history.

(56) References Cited

U.S. PATENT DOCUMENTS

| | | | | |
|---|---|---|---|---|
| 7,227,519 | B1 | 6/2007 | Kawase et al. | |
| 8,749,457 | B2 * | 6/2014 | Segawa | G09G 3/3233 345/77 |
| 9,076,387 | B1 * | 7/2015 | Lee | G09G 3/3258 |
| 2005/0023986 | A1 * | 2/2005 | Mizukoshi | G09G 3/3208 315/169.3 |
| 2005/0057191 | A1 * | 3/2005 | Jo | G09G 3/3233 315/291 |
| 2007/0279337 | A1 * | 12/2007 | Kim | G09G 3/3233 345/76 |
| 2008/0231562 | A1 * | 9/2008 | Kwon | G09G 3/3233 345/77 |

(Continued)

FOREIGN PATENT DOCUMENTS

JP 2001-350442 A 12/2001

*Primary Examiner* — Mihir K Rayan

(74) *Attorney, Agent, or Firm* — ScienBiziP, P.C.

(57) ABSTRACT

A display panel of a display device includes a plurality of pixels each including a self-light-emitting element as a light source. In a non-display period of the display panel, the display panel detects deterioration data indicating the deterioration condition of the display panel. In the non-display period of the display panel, a host device of the display device generates a correction parameter for correcting the gradation value of each pixel of the input image based on the deterioration data obtained from the display panel.

9 Claims, 5 Drawing Sheets

(56) References Cited

U.S. PATENT DOCUMENTS

| | | | | |
|---|---|---|---|---|
| 2009/0027377 | A1* | 1/2009 | Kwon | G09G 3/3233<br>345/214 |
| 2012/0147070 | A1* | 6/2012 | Segawa | G09G 3/3233<br>345/694 |
| 2014/0368556 | A1* | 12/2014 | Funatsu | G09G 3/3241<br>345/690 |
| 2016/0189617 | A1* | 6/2016 | Park | G09G 5/10<br>345/690 |

* cited by examiner

DISPLAY DEVICE, CONTROL DEVICE, AND METHOD FOR CONTROLLING DISPLAY DEVICE

BACKGROUND

1. Field

The present disclosure relates to a display device including a display that has a self-light-emitting element as a light source.

2. Description of the Related Art

Some display devices in recent years have a display that uses a self-light-emitting element such as an organic light-emitting diode (OLED) as a light source. Japanese Unexamined Patent Application Publication No. 2001-350442 discloses an example of a method for driving such a display panel (self-light-emitting panel). Specifically, the technology described in Japanese Unexamined Patent Application Publication No. 2001-350442 is aimed to correct (compensate for) deterioration of the self-light-emitting panel without interrupting the video output.

However, the technology described in Japanese Unexamined Patent Application Publication No. 2001-350442 involves a hardware element (such as a correction circuit) dedicated for the above-mentioned correction to be provided in the self-light-emitting panel. Therefore, the technology described in Japanese Unexamined Patent Application Publication No. 2001-350442 consequently involves complication of the configuration (particularly the hardware configuration) of the self-light-emitting panel. It is desirable to correct deterioration of a display (such as a self-light-emitting panel) that has a self-light-emitting element as a light source while avoiding the complication of the configuration of the display.

SUMMARY

According to an aspect of the disclosure, there is provided a display device including at least one display capable of displaying an input image; and at least one control device that controls the display. The display includes a plurality of pixels each including a self-light-emitting element as a light source. In a non-display period of the display, the display detects deterioration data indicating a deterioration condition of the display, and the control device generates a correction parameter for correcting a gradation value of each pixel of the input image based on the deterioration data obtained from the display.

According to another aspect of the disclosure, there is provided a control device that controls a display device including a display capable of displaying an input image. The display includes a plurality of pixels each including a self-light-emitting element as a light source. In a non-display period of the display, the display detects deterioration data indicating a deterioration condition of the display. The control device includes a correction parameter generating unit that, in the non-display period, (i) obtains the deterioration data from the display, and (ii) generates a correction parameter for correcting a gradation value of each pixel of the input image based on the deterioration data.

According to yet another aspect of the disclosure, there is provided a method for controlling a display device including a display capable of displaying an input image and a control device that controls the display. The display includes a plurality of pixels each including a self-light-emitting element as a light source. The method includes: in a non-display period of the display, detecting, in the display, deterioration data indicating a deterioration condition of the display; and generating, in the control device, a correction parameter for correcting a gradation value of each pixel of the input image based on the deterioration data obtained from the display.

An aspect of the disclosure advantageously provides a display device correcting deterioration of a display that has a self-light-emitting element as a light source while avoiding the complication of the configuration of the display. Another aspect of the disclosure advantageously provides a control device and a method for controlling a display device both being capable of achieving similar effects.

DESCRIPTION OF THE EMBODIMENTS

First Embodiment

Figure 1:
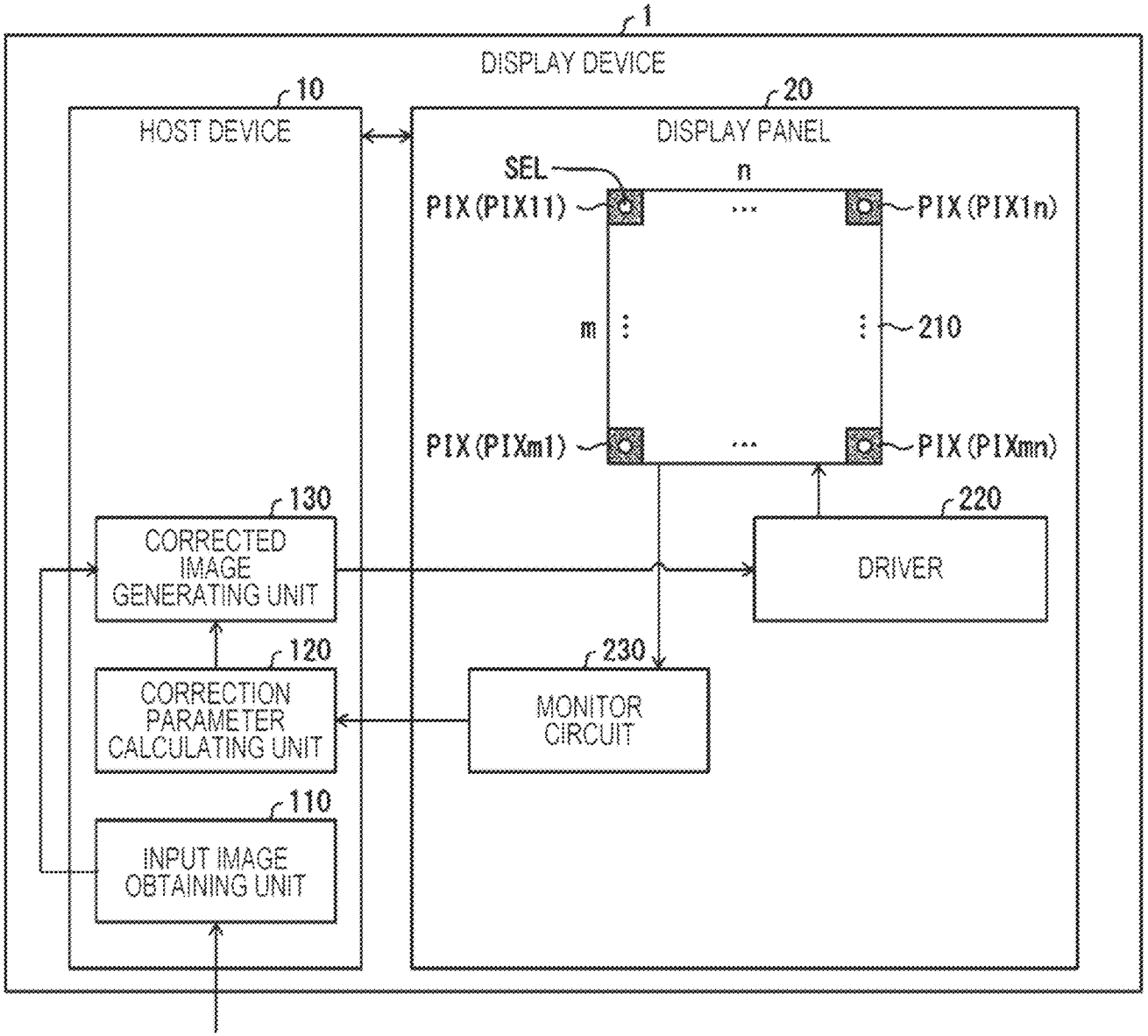
FIG. 1 is a functional block diagram illustrating the configuration of a major part of a display device according to a first embodiment.

A display device 1 according to a first embodiment will be described hereinafter. For the sake of convenience, members that have the same functions as those described in the first embodiment will be given the same symbols in the following embodiments, and descriptions thereof will not be repeated. Descriptions of matters that are the same as or similar to those of the related art will be appropriately omitted. Note that the device configuration illustrated in the drawings is only one example for the sake of description. Thus, each member is not necessarily drawn to actual scale. In addition, the positional relationship between members is not limited to examples illustrated in the drawings.

Overview of Display Device 1

FIG. 1 is a functional block diagram illustrating the configuration of a major part of the display device 1. The display device 1 includes a host device 10 (control device) and a display panel 20 (display). FIG. 1 illustrates an exemplary case in which there are one control device and one display. However, at least one of the control device and the display may be provided in plurality. It is sufficient for a display device according to an aspect of the present disclosure to include (i) at least one display device and (ii) at least one display.

The host device 10 integrally controls the units of the display device 1. In particular, the host device 10 controls the display panel 20 in the first embodiment. The host device 10 includes a processor (not illustrated) (such as a central processing unit (CPU) and a graphics processing unit (GPU)), and a storage unit (not illustrated) (such as random-access memory (RAM) and read-only memory (ROM)). The host device 10 also includes a data converter (not illustrated)

and a communication interface (not illustrated) for transmitting and receiving data to and from the display panel 20. Regarding these points, the same applies to the display panel 20. The units of the host device 10 will be described later.

Display Panel 20

The display panel 20 includes a pixel array 210, a driver 220, and a monitor circuit 230. The display panel 20 includes a plurality of self-light-emitting elements SEL as a light source. The display panel 20 is an example of a self-light-emitting panel. Hereinafter, a "self-light-emitting element SEL" may also be abbreviated simply as a "SEL". Other members may similarly be abbreviated in an appropriate manner.

A SEL in the first embodiment may be a light-emitting element (EL element) of the related art, which emits light using electro-luminescence (EL). For example, an organic EL element of the related art is used as a SEL in the first embodiment. Thus, the display panel 20 in the first embodiment may also be referred to as an organic EL display panel (or simply as an organic EL panel). More specifically, a SEL is an OLED in the example in the first embodiment. Therefore, the display panel 20 in the first embodiment may also be referred to as an OLED display panel (or simply as an OLED panel).

In the first embodiment, the row direction, that is, the direction in which rows are arranged (longitudinal or vertical direction), and the column direction, that is, the direction in which columns are arranged (lateral direction or horizontal direction), are defined in advance. Multiple pixels PIXes are arranged in the row direction and the column direction in the pixel array 210. In the example illustrated in FIG. 1, the number of vertical pixels in the pixel array 210 is represented as m, and the number of horizontal pixels in the pixel array 210 is represented as n, where m and n are integers greater than or equal to 2.

The total number of pixels NPIX included in the pixel array 210 is represented as NPIX=m×n. The area (pixel array area) of the pixel array 210 defines an active area (displayable area) of the display panel 20. One PIX includes at least one SEL. Therefore, the display panel 20 includes at least NPIX SELs. In the examples illustrated in FIG. 1 and FIG. 2 (described later), one PIX is provided with one SEL. Each PIX includes a plurality of transistors (not illustrated in FIG. 1) for driving each SEL in that PIX.

In the present specification, a certain row in the pixel array 210 is represented by the subscript k, where k is an integer that satisfies $1 \leq k \leq m$. In addition, a certain column in the pixel array 210 is represented by the subscript l, where l is an integer that satisfies $1 \leq l \leq n$. In addition, a PIX positioned at the k-th row, l-th column in the pixel array 210 is also referred to as "PIX kl" in order to distinguish the individual PIXes. For example, PIX 11 illustrated in FIG. 1 is a pixel positioned at the first row, first column (the first pixel) in the pixel array 210. In contrast, PIX mn is a pixel positioned at the m-th row, n-th column (the NPIX-th pixel) in the pixel array 210.

The driver 220 controls display of the display panel 20. The driver 220 is also referred to as a display driver. In the example illustrated in FIG. 1, the driver 220 is implemented by an integrated circuit (IC). As an example, the driver 220 includes a source driver and a gate driver.

Specifically, the driver 220 displays a desired image (such as IMG 1 or IMG 2 described later) on the display panel 20 by driving each PIX (more strictly, by controlling the light-emitting intensity of each SEL in each PIX). In the first embodiment, an exemplary case of displaying IMG 2 on the display panel 20 will be described.

The monitor circuit 230 detects data indicating the deterioration condition (hereinafter, deterioration data) of the display panel 20 in a non-display period (display OFF period) of the display panel 20. As will be described later, the monitor circuit 230 detects deterioration data from each PIX. Hereinafter, a process of detecting deterioration data by the monitor circuit 230 will also be referred to as a panel sensing process. Note that no panel sensing process is executed in a display period (display ON period) of the display panel 20.

Example of Panel Sensing Process

Figure 2A:
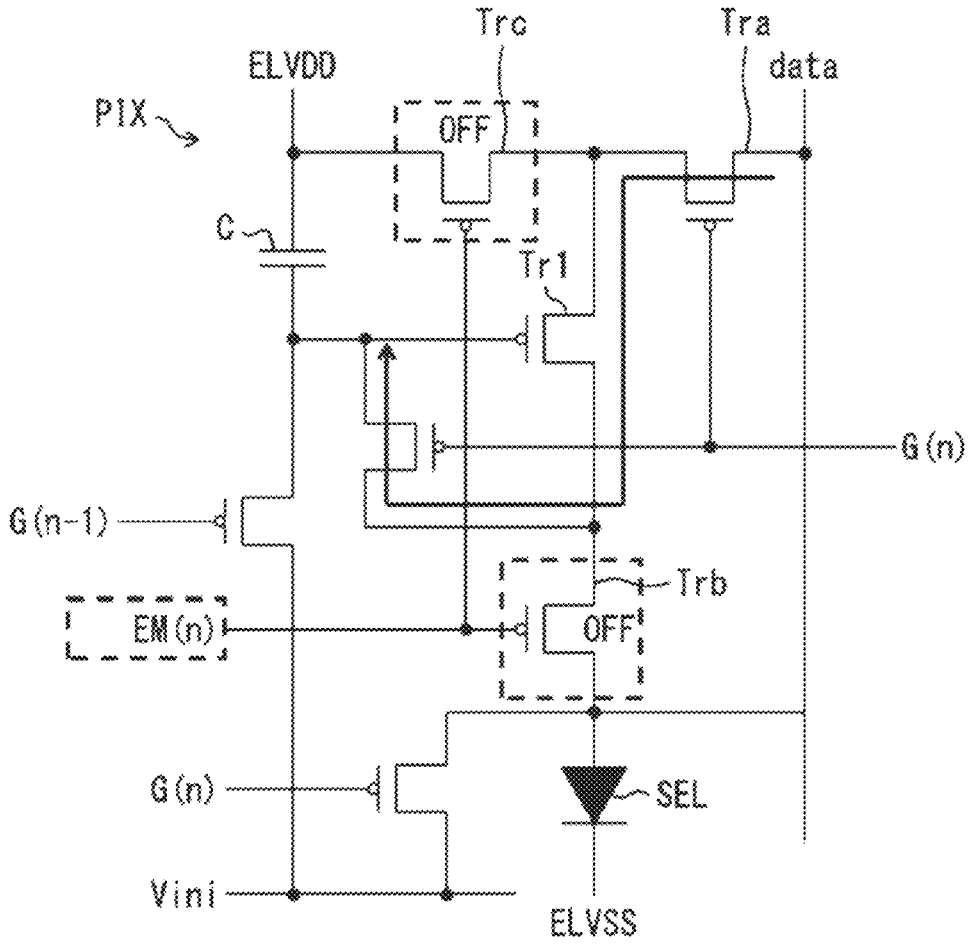
FIG. 2A is a diagram for describing an example of a panel sensing process.
Figure 2B:
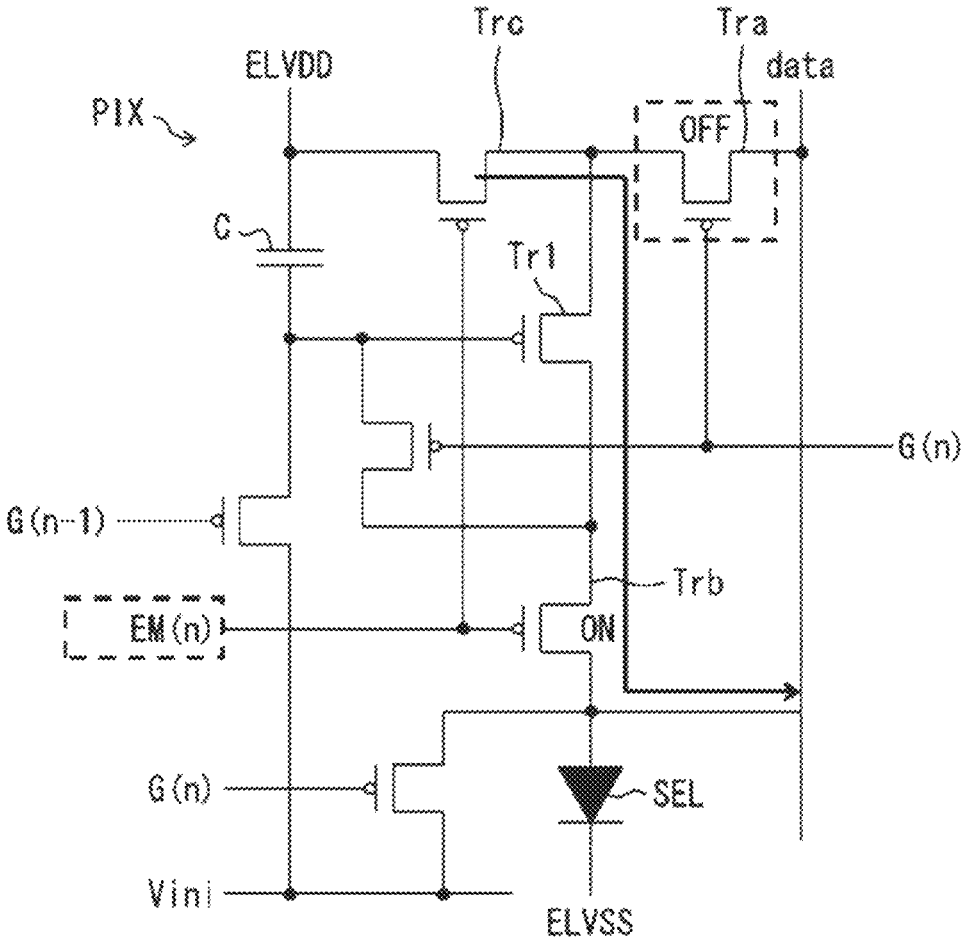
FIG. 2B is a diagram for describing an example of a panel sensing process.

FIGS. 2A and 2B are diagrams for describing an example of a panel sensing process. FIGS. 2A and 2B are diagrams for describing a first process and a second process, respectively. An exemplary configuration of one PIX is illustrated in FIGS. 2A and 2B. In FIGS. 2A and 2B, descriptions of circuit elements and signal lines that are of low relevance to the first embodiment are omitted.

Each PIX is provided with a plurality of transistors (such as transistors Trl and Tra to Trc) as switching elements for selectively driving the SEL. In the example illustrated in FIGS. 2A and 2B, each transistor is a thin film transistor (TFT). In addition, each PIX includes a capacitor C for holding image data (strictly, a signal line voltage with a value corresponding to image data).

First Process

In the first process, C is charged with electricity prior to the second process. As illustrated in FIG. 2A, image data is supplied from a data line to C in the first process. That is, (i) Tra and Trl are turned ON, and (ii) Trb and Trc are turned OFF in the first process. Thus, current corresponding to the above-mentioned pixel data (hereinafter, pixel-corresponding current) flows via Trl into C.

By the way, when the display panel 20 (such as an OLED panel) is used over a long period of time, deterioration over time (hereinafter simply referred to as deterioration) may occur in each element in each PIX. As an example, deterioration of each transistor in each PIX causes a decrease in the light-emitting intensity (such as luminance) of the PIX. For example, when Trl deteriorates, the impedance of Trl increases. As a result, as the pixel-corresponding current decreases, the light-emitting intensity of the PIX decreases.

From the above, the amount of electric charge that C is charged with in the first process changes according to the deterioration condition of Trl. Specifically, as Trl deteriorates more, the pixel-corresponding current decreases; thus, the above-mentioned amount of electric charge tends to decrease as well. Therefore, the deterioration condition of Trl may be evaluated on the basis of the amount of electric charge that C is charged with. Accordingly, the amount of electric charge (in other words, the pixel-corresponding current) may be one index that indicates the deterioration condition of the display panel 20.

Second Process

In the second process, deterioration data is obtained. Specifically, the amount of electric charge that C is charged with in advance in the first process is indirectly detected in order to obtain deterioration data in the second process. As illustrated in FIG. 2B, (i) Trb, Trc, and Trl are turned ON, and (ii) Tra is turned OFF in the second process in order to detect current corresponding to the above-described amount of electric charge (such as current flowing from C into Trl).

Hereinafter, "current flowing from C into Trl" in the second process will be referred to as "drive current" for the sake of convenience. The drive current corresponds to the pixel-corresponding current in the first process. Therefore, the deterioration condition of Trl may be evaluated by detecting the drive current in the second process.

To this end, the monitor circuit 230 may obtain deterioration data on the basis of the drive current. It is assumed in the following description that the monitor circuit 230 includes a current sensor (not illustrated) capable of detecting the drive current.

As an example, the monitor circuit 230 calculates, as deterioration data (Id) of each PIX, the difference between (i) the ideal value (design value) (hereinafter, Ii) of the drive current, and (ii) the measured value (hereinafter, Ir) of the drive current, corresponding to certain pixel data. That is, the monitor circuit 230 calculates Id by the following equation (1):

$$Id=Ii-Ir \quad (1)$$

When Trl has not deteriorated that much, Ir is a value relatively close to Ii. Therefore, when Id is sufficiently small, it may be evaluated that the PIX has not deteriorated that much. In contrast, when Trl has deteriorated to some extent, Ir becomes significantly smaller than Ii. Therefore, when Id is large to some extent, it may be evaluated that the PIX has deteriorated to some extent.

The monitor circuit 230 obtains Id for each PIX (PIX 11 to PIX mn) of the pixel array 210. Hereinafter, Id of PIX kl will be referred to as Id kl. The monitor circuit 230 obtains Id 11 to Id mn. These items of deterioration data (Id 11 to Id mn) may also be collectively expressed as data that indicates the deterioration condition of the display panel 20.

Host Device 10

The host device 10 includes an input image obtaining unit 110, a correction parameter calculating unit 120 (correction parameter generating unit), and a corrected image generating unit 130. The input image obtaining unit 110 obtains an input image (hereinafter, IMG 1) in the display ON period. IMG 1 may be each frame of a moving image, or a still image stored in advance in a storage device (not illustrated) in the display device 1.

The correction parameter calculating unit 120 obtains deterioration data (Id 11 to Id mn) from the monitor circuit 230 in the display OFF period. The correction parameter calculating unit 120 generates correction parameters on the basis of the deterioration data in the display OFF period. A correction parameter is a parameter for correcting the gradation value of each pixel of IMG 1. In the following description, a correction parameter is represented as γ. An example of a method for generating γ (may also be referred to as a correction algorithm) will be described later.

In the display ON period, the corrected image generating unit 130 corrects the gradation value of each pixel of IMG 1 using γ generated in advance in the display OFF period. Hereinafter, "correcting the gradation value of each pixel of IMG 1" will also be referred to simply as "correcting the gradation value of IMG 1" (or "correcting IMG 1"). The corrected image generating unit 130 generates an output image (hereinafter, IMG 2) by correcting IMG 1.

Hereinafter, the gradation value of each pixel of IMG 1 will also be referred to simply as "the gradation value of IMG 1". Regarding this point, the same applies to IMG 2. In addition, the gradation value of one pixel of IMG 1 is referred to as x (input gradation value). In contrast, the gradation value of one pixel of IMG 2 that corresponds to the above-mentioned pixel of IMG 1 is referred to as y (output gradation value). It is assumed in the present specification that x and y are standardized gradation values. In short, x and y satisfy $0 \le x \le 1$ and $0 \le y \le 1$, respectively, in both of IMG 1 and IMG 2.

As an example, the corrected image generating unit 130 corrects x (calculates y) using the following equation (2):

$$y=x^{\gamma} \quad (2)$$

where equation (2) is the same as or similar to a formula that represents the so-called γ correction. Note that, in the display device 1, unlike γ correction of the related art, an individual γ is set for each pixel (pixel 1 to pixel TPIX) of IMG 1. TPIX is the number of pixels of IMG 1. A pixel i is the i-th pixel ($1 \le i \le TPIX$) of IMG 1. Hereinafter, x of the pixel i will be referred to as xi. In addition, γ applied to xi will be referred to as γi, and γ corresponding to xi will be referred to as γi.

That is, the corrected image generating unit 130 corrects xi (calculates γi) using the following equation (3):

$$\gamma i=xi^{\gamma i} \quad (3)$$

By correcting IMG 1 in this manner, deterioration (a decrease in the light-emitting intensity) of each pixel of the display panel 20 may be corrected. According to equation (3), unlike the case in which a uniform γ is applied to all the pixels of IMG 1 (γ correction of the related art), deterioration of local pixels in the display panel 20 may be taken into consideration. Therefore, the display quality of IMG 2 may be improved, compared with γ correction of the related art.

Note that γ1 to γTPIX need not to be set to different values. For example, if Id 11 to Id mn are close values and are sufficiently small values, γ1 to γTPIX may be set to an equal value.

Example of Flow of Process in Display OFF Period

At first, the monitor circuit 230 performs a panel sensing process, and obtains deterioration data (Id 11 to Id mn). Next, the correction parameter calculating unit 120 obtains the deterioration data from the monitor circuit 230. The correction parameter calculating unit 120 generates correction parameters (γ1 to γTPIX) on the basis of the deterioration data.

Example of Flow of Process in Display ON Period

At first, the input image obtaining unit 110 obtains IMG 1. Next, the corrected image generating unit 130 obtains correction parameters that are generated in advance by the correction parameter calculating unit 120. The corrected image generating unit 130 generates IMG 2 by correcting IMG 1 using the correction parameters.

Next, the corrected image generating unit 130 supplies the generated IMG 2 to the display panel 20 (more specifically, the driver 220). The driver 220 displays IMG 2 on the display panel 20. By displaying IMG 2 (an image where the deterioration of the display panel 20 has been corrected) instead of IMG 1 on the display panel 20 in this manner, even if the display panel 20 deteriorates, degradation of the display quality of an image that the user appreciates may be prevented. More specifically, unevenness in the light-emitting intensity (light-emitting unevenness) of the image may be suppressed.

Example of Correction Parameter Generating Process

As an example, a preliminary experiment on the relationship between Id and γ is conducted by the manufacturer of a display device (such as the display device 1) according to an aspect of the present disclosure (hereinafter, the manufacturer). Specifically, the manufacturer examines the following experimentally in advance: (i) "when deterioration data of a certain PIX is a certain value, how much the light-emitting intensity of the PIX decreases"; and (ii) "how γ may be set to correct a decrease in the light-emitting intensity of the PIX". The manufacturer creates a table indicating the corresponding relationship between Id and γ (hereinafter, TABLE) on the basis of the experiment result.

In TABLE, at least two types of the corresponding relationship between the representative values of Id and the representative values of γ are set. Note that the value of Id at the start of the experiment and the value of Id at the end of the experiment are referred to as initial deterioration data and final deterioration data, respectively. Each representative value of Id and each representative value of γ are set on the basis of the initial deterioration data and the final deterioration data.

The correction parameter calculating unit 120 sets γ according to the deterioration data obtained from the monitor circuit 230 on the basis of TABLE. Hereinafter, the case in which the number of pixels of the display panel 20 (specifically, the pixel array 210) and the number of pixels of IMG 1 are the same will be considered for the sake of simplicity. In short, the case in which each pixel of the display panel 20 and each pixel of IMG 1 have a one-to-one correspondence will be considered. In the following description, Id that has a one-to-one correspondence with γi will be referred to as Idi.

As an example, the correction parameter calculating unit 120 sets an interpolation formula of γ on the basis of the corresponding relationship between the representative values of Id and the representative values of γ indicated in TABLE. In the interpolation formula, γ is represented as a function of Id. That is, γ=f(Id). As an example, the correction parameter calculating unit 120 performs linear interpolation of the above-mentioned corresponding relationship to set the above-mentioned interpolation formula. This is because that, to simplify the derivation of γ, it is preferable that the above-mentioned function be set as a linear function.

Here, if Id=0 (no deterioration), it may be set that γ=0 (no correction). To this end, derivation of γ may be particularly simplified by setting the above-mentioned function as a proportional function. That is, the interpolation formula may be set as:

$$\gamma=f(Id)=\alpha\times Id \tag{4}$$

where a is a constant (coefficient of proportionality).

As an example, the case in which the correction parameter calculating unit 120 generates γ1 is considered. The correction parameter calculating unit 120 sets γ1 corresponding to Id 1 (that is, Id 11) obtained from the monitor circuit 230 on the basis of TABLE. Specifically, the correction parameter calculating unit 120 sets γ1 according to Id 1 on the basis of equation (4) where γ1=α×Id 1. Thereafter, the same applies to γ2 to γTPIX.

When the number of pixels of the display panel 20 is different from the number of pixels of IMG 1, the corresponding relationship that "which pixel of IMG 1 corresponds to which pixel of the display panel 20" may be set in advance. Moreover, γ may be set in advance using Id of a PIX group corresponding to one pixel of IMG 1.

As an example, the case in which one pixel (such as pixel 1) of IMG 1 corresponds to two pixels (such as PIX 11 and PIX 12) of the display panel 20 is considered. In this case, the correction parameter calculating unit 120 may set the representative value of Id 11 and Id 12 as Id 1. Then, the correction parameter calculating unit 120 may set γ1 on the basis of equation (4).

Although the above-described representative value setting method is arbitrary, it is preferable that Id 1 be set as the greater value of Id 11 and Id 12. In short, it is preferable that Id 1 be set as Id 1=Max(Id 11, Id 12). As an example, if Id 11>Id 12, it is set that Id 1=Id 11. This is because that, in view of the purpose of correcting a decrease in the light-emitting intensity of the display panel 20, it is preferable to perform correction with reference to a pixel (such as PIX 11) where deterioration of the light-emitting intensity is more striking.

Advantageous Effects

As has been described above, the related art (such as the technology described in Japanese Unexamined Patent Application Publication No. 2001-350442) involves a hardware element dedicated for generating a correction parameter to be provided in the self-light-emitting panel. In contrast, the display device 1 has the correction parameter calculating unit 120 provided in the host device 10. Thus, unlike the related art, deterioration of the display panel (self-light-emitting panel) may be corrected while avoiding the complication of the configuration of the display panel 20.

In the related art, for example, to newly develop a driver in the display panel, the hardware design of a correction circuit needs to be completed in advance. That is, in the related art, the determination of a correction algorithm applied in a correction circuit needs to be waited for before starting the development of a driver. As described here, it is difficult in the related art to sufficiently reduce the development period of a display device because the determination of a correction algorithm (design of a correction circuit) becomes a bottleneck.

In contrast, in the display device 1, the correction parameter calculating unit 120 may be implemented as, for example, software. This dispenses with the hardware design of a correction circuit, thereby allowing more flexible development of a correction algorithm than in the related art. For example, the development of a correction algorithm may be conducted in parallel with the development of a driver in the display panel. As described here, according to the display device 1, the development of a display device may be performed more efficiently than in the past, thereby reducing the development period of a display device.

Furthermore, in the display device 1, a panel sensing process is executed only in the display OFF period. By executing no panel sensing process in the display ON period, reduction in the rendering speed of the display panel 20 (such as reduction in the speed of rending IMG 2) may be prevented. In addition, because the display device 1 actually measures deterioration data on the basis of the drive current, deterioration data may be detected more accurately than a method for estimating deterioration data. Therefore, IMG 1 may be corrected by reflecting the substantial deterioration condition of the display panel 20. From the above point, the display device 1 is useful for improving the display quality of IMG 2.

Supplements

Initial characteristic information of the display panel 20 may be stored in advance in a storage device (not illustrated) in the display device 1. The initial characteristic information refers collectively to items of information indicating the characteristics of the individual pixels of the display panel 20. It is preferable that the correction parameter calculating unit 120 calculate correction parameters (γ1 to γTPIX) further on the basis of the initial characteristic information.

Some self-light-emitting panels (such as OLED panels) may have pixels whose characteristics vary in the initial state (at the time point at which the self-light-emitting panels are manufactured). By further using the initial characteristic information, the correction parameters (γ1 to γTPIX) may be calculated by taking into consideration the influence of the above-mentioned variations. Therefore, the display quality of IMG 2 may be further improved.

Second Embodiment

Figure 3:
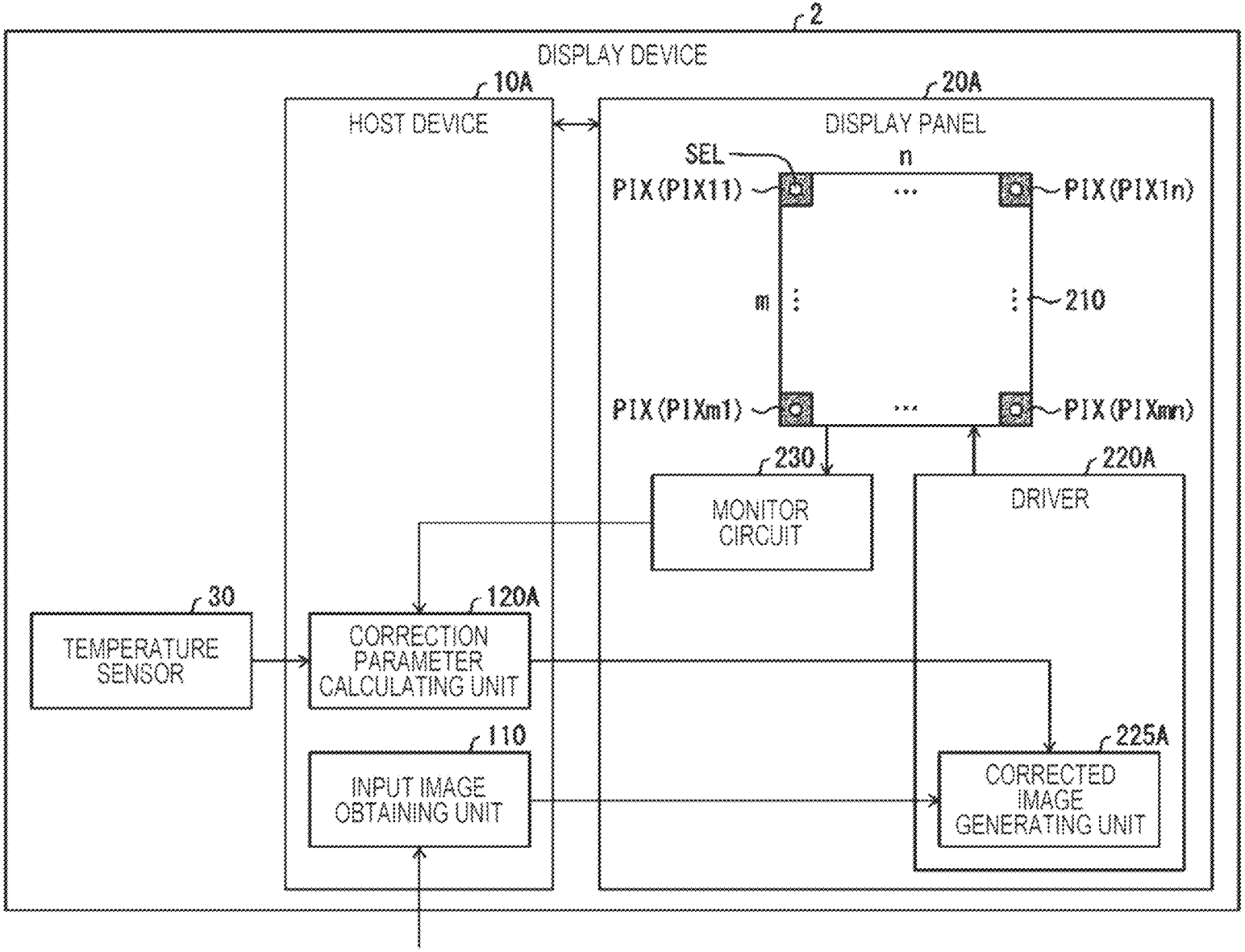
FIG. 3 is a functional block diagram illustrating the configuration of a major part of a display device according to a second embodiment.

FIG. 3 is a functional block diagram illustrating the configuration of a major part of a display device 2 according to a second embodiment. A host device and a display panel of the display device 2 will be referred to as a host device 10A (control device) and a display panel 20A (display), respectively. Unlike the display device 1, the display device 2 further includes a temperature sensor 30. A driver of the display panel 20A will be referred to as a driver 220A.

Unlike the host device 10, the host device 10A does not have the corrected image generating unit 130. A correction parameter calculating unit of the host device 10A will be referred to as a correction parameter calculating unit 120A (correction parameter generating unit). As will be described hereinafter, unlike the correction parameter calculating unit 120, the correction parameter calculating unit 120A may adjust γ on the basis of a temperature (T) detected by the temperature sensor 30. The temperature sensor 30 detects, for example, the ambient temperature of the display device 2.

Unlike the display device 1, in the display device 2, the corrected image generating unit is provided in the display panel 20A. The corrected image generating unit in the display panel 20A will be referred to as a corrected image generating unit 225A. In the example illustrated in FIG. 3, the corrected image generating unit 225A is provided in the driver 220A.

In the display ON period, the corrected image generating unit 225A (i) obtains IMG 1 from the input image obtaining unit 110, and (ii) obtains γ (more specifically, later-described γ (after temperature adjustment)) from the correction parameter calculating unit 120A. Then, the corrected image generating unit 225A corrects IMG 1 using γ in the display ON period.

As above, IMG 2 is generated in the display panel 20A of the display device 2. By providing the corrected image generating unit in the display, the configuration of the control device may be made simpler than that in the first embodiment. When it is preferable to simplify the configuration of the display, the corrected image generating unit may be provided in the control device, as in the first embodiment.

Example of Process Performed by Correction Parameter Calculating Unit 120A

The electrical characteristics of each element in each PIX may change according to T. More specifically, the drive current tends to decrease as T becomes greater. Thus, the light-emitting intensity of each PIX decreases as T becomes greater. As an example, the manufacturer conducts a preliminary experiment on the relationship between T and γ.

Specifically, the manufacturer examines the following experimentally in advance: (i) "when the temperature of a certain PIX is a certain value different from a reference temperature, how fast (or slow) the deterioration of the PIX is compared with the case of the reference temperature"; and (ii) "how γ may be set to correct a decrease in the light-emitting intensity of the PIX". The manufacturer creates a table indicating the corresponding relationship between T and γ (hereinafter, TABLE 2) on the basis of the experiment result. In TABLE 2, at least two types of the corresponding relationship between the representative values of T and the representative values of γ are set.

As an example, the correction parameter calculating unit 120A sets an interpolation formula of γ on the basis of the corresponding relationship between the representative values of T and the representative values of γ indicated in TABLE 2. In the interpolation formula, γ is represented as a function of T. That is, γ=g(T). As an example, the correction parameter calculating unit 120A performs linear interpolation of the above-mentioned corresponding relationship to set the above-mentioned interpolation formula.

That is, the interpolation formula may be set as:

$$\gamma\ (\text{after temperature adjustment}) = g(T) = \beta \times (T - T0) + \gamma\ (\text{before temperature adjustment}) \quad (5)$$

where β is a constant, T0 is the reference temperature, and γ (before temperature adjustment) is γ at T0.

As an example, the case in which the correction parameter calculating unit 120A calculates and performs temperature adjustment of γ1 is considered. At first, the correction parameter calculating unit 120A calculates γ1 (before temperature adjustment) using, for example, equation (4). Next, the correction parameter calculating unit 120A adjusts γ1 (before temperature adjustment) in accordance with T (that is, calculates γ1 (after temperature adjustment)) using equation (5).

As described here, according to the correction parameter calculating unit 120A, γ may be set by additionally taking into consideration the influence of T. Therefore, according to the display device 2, the display quality of IMG 2 may be further improved.

Third Embodiment

Figure 4:
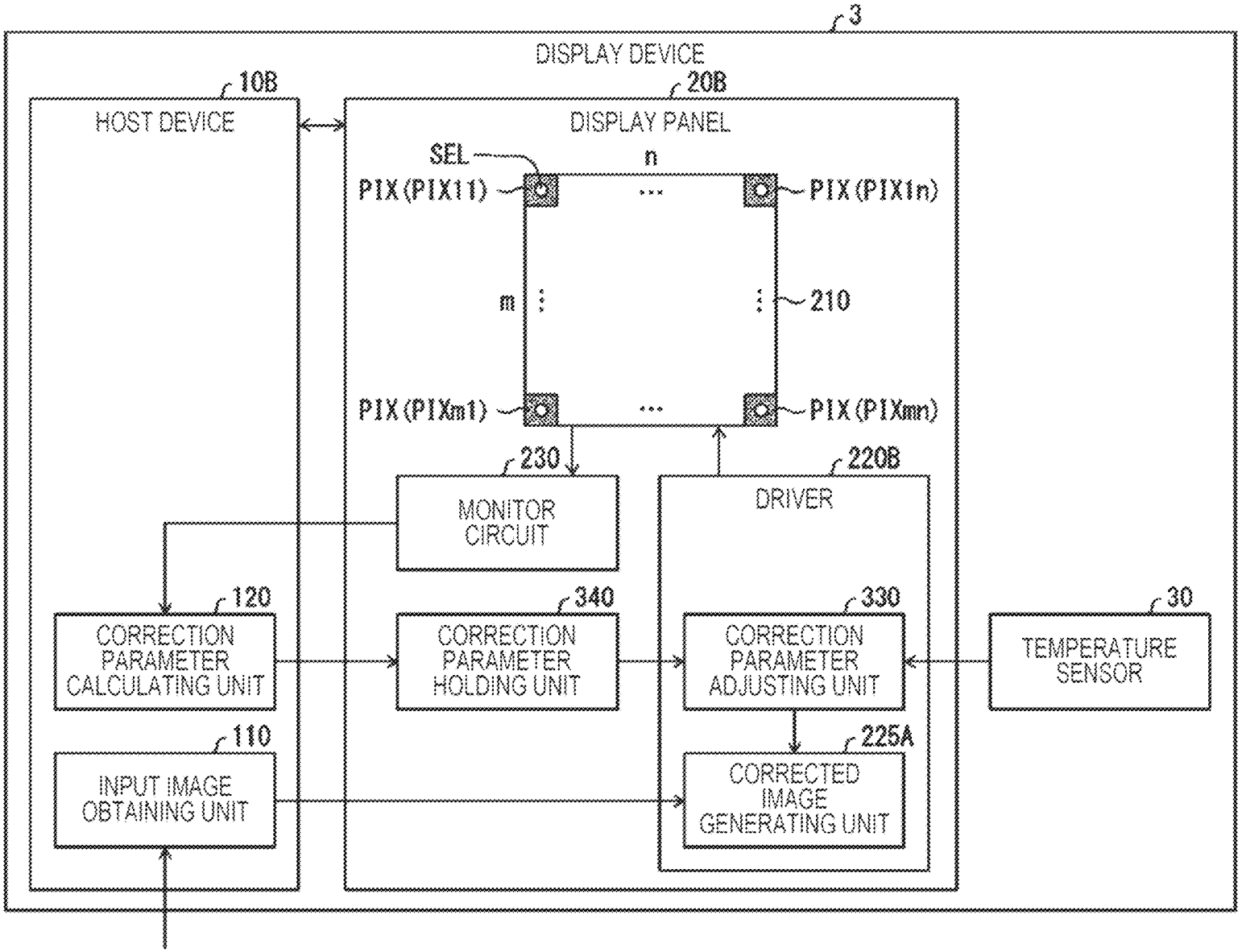
FIG. 4 is a functional block diagram illustrating the configuration of a major part of a display device according to a third embodiment.

FIG. 4 is a functional block diagram illustrating the configuration of a major part of a display device 3 according to a third embodiment. The display device 3 is a modification of the display device 2. A host device and a display panel of the display device 3 will be referred to as a host device 10B (control device) and a display panel 20B (display), respectively. A driver of the display panel 20B will be referred to as a driver 220B.

In the host device 10B, the correction parameter calculating unit 120A of the host device 10A is replaced by the correction parameter calculating unit 120 in the first embodiment. Unlike the display panel 20A, the display panel 20B further includes a correction parameter adjusting unit 330 and a correction parameter holding unit 340. In the example illustrated in FIG. 4, the correction parameter adjusting unit 330 is provided in the driver 220B. The correction parameter adjusting unit 330 may be implemented by, for example, a microprocessor. The correction parameter holding unit 340 may be a storage device of the related art.

The correction parameter holding unit 340 obtains γ (more specifically, the above-mentioned γ (before temperature adjustment)) calculated by the correction parameter calculating unit 120, and holds γ. By providing the correction parameter holding unit 340, it becomes unnecessary for the correction parameter calculating unit 120 to calculate γ in real time every time, thereby reducing the amount of processing performed by the control device.

The correction parameter adjusting unit 330 obtains γ (before temperature adjustment) stored in the correction parameter holding unit 340. The correction parameter adjusting unit 330 calculates γ (after temperature adjustment), like the correction parameter calculating unit 120A (such as using the above-mentioned equation (5)). As described here, the temperature adjustment of γ may be performed by the display. In doing so, the configuration of the control device may be simplified.

Modifications

A control device according to an aspect of the present disclosure is not necessarily limited to a host device. As an example, one or some functional units (such as the correction parameter calculating unit 120) of the host device may be implemented by a microprocessor. As described here, a control device according to an aspect of the present disclosure may include a microprocessor. In short, one control device as a whole may be implemented by a combination of a host device and a microprocessor.

Implementation Examples Using Software

Control blocks (particularly the host devices 10 to 10B and the drivers 220 to 220B) of the display devices 1 to 3 may be implemented by a logic circuit (hardware) formed on an integrated circuit (IC) (IC chip) or the like, or may be implemented by software.

In the latter case, the display devices 1 to 3 include a computer for executing commands of a program which is software for implementing the functions. This computer includes, for example, at least one processor (control device), and at least one computer-readable recording medium storing the program. An object of an aspect of the present disclosure is implemented by the computer by reading, by the processor, the program from the recording medium and executing the program. For example, a central processing unit (CPU) may be used as the processor. For example, a "non-temporary and physical medium", such as a tape, a disk, a card, semiconductor memory, or a programmable logic circuit, may be used as the recording medium, besides read-only memory (ROM). In addition, random-access memory (RAM) for expanding the program may be further provided. Alternatively, the program may be provided to the computer via an arbitrary transmission medium (such as a communication network or a broadcasting wave) capable of transmitting the program. Note that an aspect of the present disclosure may also be achieved in a form of data signals embedded in a carrier wave, which is implementation of the program by electronic transmission.

CONCLUSION

A display device (1) according to a first aspect of the present disclosure is a display device including at least one display (display panel 20) capable of displaying an input image (IMG 1), and at least one control device (host device 10) that controls the display. The display includes a plurality of pixels (PIXes) each including a self-light-emitting element (SEL) as a light source. In a non-display period of the display, the display detects deterioration data (Id) indicating a deterioration condition of the display, and the control device generates a correction parameter (γ) for correcting a gradation value of each pixel of the input image based on the deterioration data obtained from the display.

According to the above-described configuration, unlike the related art, a process of generating (calculating) a correction parameter may be performed not in the display (such as a self-light-emitting panel), but in the control device. Therefore, deterioration of the display may be corrected while avoiding the complication of the configuration (particularly the hardware configuration) of the display.

In a display device according to a second aspect of the present disclosure, in the first aspect, the control device may generate a corrected image (IMG 2) by correcting the gradation value of each pixel of the input image using the correction parameter.

According to the above-described configuration, the configuration of the display may be simplified by causing the control device to perform a process of correcting an input image.

In a display device according to a third aspect of the present disclosure, in the first aspect, the display may generate a corrected image by correcting the gradation value of each pixel of the input image using the correction parameter.

According to the above-described configuration, the configuration of the control device may be simplified by causing the display to perform a process of correcting an input image.

In a display device according to a fourth aspect of the present disclosure, in any one of the first to third aspects, the display may be an organic electro-luminescence (EL) display panel including an organic EL element as the self-light-emitting element.

A control device according to a fifth aspect of the present disclosure is a control device that controls a display device including a display capable of displaying an input image. The display includes a plurality of pixels each including a self-light-emitting element as a light source. In a non-display period of the display, the display detects deterioration data indicating a deterioration condition of the display. The control device includes a correction parameter generating unit (correction parameter calculating unit 120) that, in the non-display period, (i) obtains the deterioration data from the display, and (ii) generates a correction parameter for correcting a gradation value of each pixel of the input image based on the deterioration data.

A display apparatus controlling method according to a sixth aspect of the present disclosure is a method for controlling a display device including a display capable of displaying an input image and a control device that controls the display. The display includes a plurality of pixels each including a self-light-emitting element as a light source. The method includes: in a non-display period of the display, detecting, in the display, deterioration data indicating a deterioration condition of the display; and generating, in the control device, a correction parameter for correcting a gradation value of each pixel of the input image based on the deterioration data obtained from the display.

Appendix

An aspect of the present disclosure is not limited to the above-described embodiments, and various changes may be made within the scope of the claims. An embodiment obtained by appropriately combining technical means disclosed in different embodiments is also included in the technical scope of an aspect of the present disclosure. Furthermore, a new technical feature may be formed by combining technical means disclosed in the embodiments.

The present disclosure contains subject matter related to that disclosed in Japanese Priority Patent Application JP 2019-043090 filed in the Japan Patent Office on Mar. 8, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

at least one display capable of displaying an input image; and at least one control device that controls the display, wherein:

the display includes a plurality of pixels each including a self-light-emitting element as a light source;

the display includes a transistor for selectively driving the self-light-emitting element and a capacitor for holding image data; and in a non-display period of the display, the display detects deterioration data indicating a deterioration condition of the transistor on a basis of a change in an amount of electric charge that the capacitor is charged with, the change in the amount of the electric charge is detected with a current flowing from the capacitor into the transistor, and the control device generates a correction parameter for correcting a gradation value of each pixel of the input image based on the deterioration data obtained from the display.

2. The display device according to claim 1, wherein the control device generates a corrected image by correcting the gradation value of each pixel of the input image using the correction parameter.

3. The display device according to claim 1, wherein the display generates a corrected image by correcting the gradation value of each pixel of the input image using the correction parameter.

4. The display device according to claim 1, wherein the display is an organic electro-luminescence (EL) display panel including an organic EL element as the self-light-emitting element.

5. A control device that controls a display device including a display capable of displaying an input image, the display including a plurality of pixels each including a self-light-emitting element as a light source, the display including a transistor for selectively driving the self-light-emitting element and a capacitor for holding image data, in a non-display period of the display, the display detecting deterioration data indicating a deterioration condition of the transistor on a basis of a change in an amount of electric charge that the capacitor is charged with, the change in the amount of the electric charge being detected with a current flowing from the capacitor into the transistor, and the control device, in the non-display period, (i) obtaining the deterioration data from the display, and (ii) generating a correction parameter for correcting a gradation value of each pixel of the input image based on the deterioration data.

6. A method for controlling a display device including a display capable of displaying an input image and a control device that controls the display, the display including a plurality of pixels each including a self-light-emitting element as a light source, the display including a transistor for selectively driving the self-light-emitting element and a capacitor for holding image data, the method comprising:

in a non-display period of the display, detecting, in the display, deterioration data indicating a deterioration condition of the transistor on a basis of a change in an amount of electric charge that the capacitor is charged with, wherein the change in the amount of the electric charge is detected with a current flowing from the capacitor into the transistor; and generating, in the control device, a correction parameter for correcting a gradation value of each pixel of the input image based on the deterioration data obtained from the display.

7. A display device comprising:

at least one display capable of displaying an input image; and at least one control device that controls the display, wherein:

the display includes a plurality of pixels each including a self-light-emitting element as a light source;

the display includes a transistor for selectively driving the self-light-emitting element and a capacitor for holding image data;

in a non-display period of the display, the display detects deterioration data indicating a deterioration condition of the transistor on a basis of an amount of electric charge that the capacitor is charged with, and the control device generates a correction parameter for correcting a gradation value of each pixel of the input image based on the deterioration data obtained from the display;

each of the plurality of pixels includes:

a first transistor and a second transistor provided in series between an end of the capacitor and a data line; and a third transistor provided between (i) a point between the first transistor and the second transistor and (ii) an other end of the capacitor; and the display performs:

a first process in which the second transistor and the third transistor turn ON and the first transistor turns OFF during the non-display period to charge the capacitor with the electric charge from the data line through the third transistor; and a second process in which, after the first process, the first transistor and the third transistor turn ON and the second transistor turns OFF to detect the deterioration data on a basis of a current flowing from the capacitor to the third transistor.

8. The display device according to claim 7, wherein the control device generates the correction parameter for correcting deterioration of the third transistor on a basis of the deterioration data.

9. The display device according to claim 1, wherein the control device generates, as the correction parameter, a gamma value in accordance with the deterioration data for each of the plurality of pixels, and performs gamma correction on the input image on a basis of the gamma value to generate a corrected image.

* * * * *